US011229110B2

(12) United States Patent
Wang et al.

(10) Patent No.: US 11,229,110 B2
(45) Date of Patent: Jan. 18, 2022

(54) COMBINED MACHINE HEAD AND RAY IMAGING DEVICE

(71) Applicant: SUZHOU POWERSITE ELECTRIC CO., LTD., Jiangsu (CN)

(72) Inventors: Weizhong Wang, Jiangsu (CN); Jie He, Jiangsu (CN); Qiang Huang, Jiangsu (CN)

(73) Assignee: SUZHOU POWERSITE ELECTRONIC CO., LTD., Jiangsu (CN)

( * ) Notice: Subject to any disclaimer, the term of this patent is extended or adjusted under 35 U.S.C. 154(b) by 0 days.

(21) Appl. No.: 16/980,107

(22) PCT Filed: Nov. 16, 2018

(86) PCT No.: PCT/CN2018/115957
§ 371 (c)(1),
(2) Date: Sep. 11, 2020

(87) PCT Pub. No.: WO2019/174293
PCT Pub. Date: Sep. 19, 2019

(65) Prior Publication Data

US 2021/0022232 A1 Jan. 21, 2021

(30) Foreign Application Priority Data

Mar. 14, 2018 (CN) ..... 201810208702.7

(51) Int. Cl.
*H05G 1/02* (2006.01)
*H01J 35/12* (2006.01)
(Continued)

(52) U.S. Cl.
CPC ..... *H05G 1/025* (2013.01); *H01J 35/12* (2013.01); *H05G 1/06* (2013.01); *H05G 1/20* (2013.01);
(Continued)

(58) Field of Classification Search
CPC . H05G 1/025; H05G 1/06; H01J 35/12; H01J 2235/1204; H01J 2235/125
See application file for complete search history.

(56) References Cited

U.S. PATENT DOCUMENTS 2,153,795 A 4/1939 Fischer
3,134,903 A * 5/1964 Fengler ..... H01J 35/18 378/147
(Continued)

FOREIGN PATENT DOCUMENTS

CN 2751420 Y 1/2006
CN 101610720 A 12/2009
(Continued)

OTHER PUBLICATIONS

English translation of first Office Action of priority Chinese Application No. 2018102087027.
(Continued)

*Primary Examiner* — Chih-Cheng Kao
(74) *Attorney, Agent, or Firm* — Elmore Patent Law Group, P.C.; Joseph C. Zucchero; Carolyn S. Elmore

(57) ABSTRACT

The present application provides a combined machine head and a ray imaging device, wherein the combined machine head comprises: a housing, having an enclosed cavity; a ray tube, arranged in the enclosed cavity; and a pump and a pipe, arranged in the enclosed cavity; wherein the pump is arranged on one side away from an anode of the ray tube, the pipe has a first end connected with an outlet of the pump and a second end extending to be near the anode of the ray tube; or the pump is arranged near the anode of the ray tube, the pipe has a first end connected to an inlet of the pump and a second end extending to one side away from the anode of the ray tube.

8 Claims, 7 Drawing Sheets

(51) Int. Cl.
*H05G 1/06* (2006.01)
*H05G 1/20* (2006.01)

(52) U.S. Cl.
CPC . *H01J 2235/1204* (2013.01); *H01J 2235/125* (2013.01)

(56) References Cited

U.S. PATENT DOCUMENTS

| | | | | |
|---|---|---|---|---|
| 4,768,212 | A | 8/1988 | Appelt et al. | |
| 4,841,557 | A | 6/1989 | Haberrecker et al. | |
| 5,222,118 | A | 6/1993 | Gerth | |
| 6,320,936 | B1 | 11/2001 | Holland et al. | |
| 6,396,901 | B1 | 5/2002 | Hell et al. | |
| 2006/0050852 | A1 | 3/2006 | Andrews et al. | |
| 2008/0043919 | A1* | 2/2008 | Chapin | H05G 1/025 378/119 |
| 2008/0304625 | A1* | 12/2008 | Dehler | H05G 1/10 378/197 |
| 2010/0111259 | A1 | 5/2010 | Van Der Ende | |
| 2013/0114794 | A1 | 5/2013 | Yamamoto | |
| 2014/0153695 | A1* | 6/2014 | Yanagisawa | H01J 35/16 378/62 |

FOREIGN PATENT DOCUMENTS

| | | | |
|---|---|---|---|
| CN | 108257837 | A | 7/2018 |
| CN | 208225838 | U | 12/2018 |
| JP | S4720464 | U | 9/1972 |
| JP | S60136138 | A | 7/1985 |
| JP | S6281400 | U | 5/1987 |
| JP | S62201500 | U | 12/1987 |
| JP | H03120016 | U | 12/1991 |
| JP | H0568370 | A | 3/1993 |
| JP | 2001052940 | A | 2/2001 |
| JP | 2002136143 | A | 5/2002 |
| JP | 2004103568 | A | 4/2004 |
| JP | 2007005283 | A | 1/2007 |
| JP | 2010040809 | A | 2/2010 |
| JP | 2011062240 | A | 3/2011 |
| JP | 2012028093 | A | 2/2012 |
| JP | 2016154087 | A | 8/2016 |
| WO | 2013042812 | A1 | 3/2013 |
| WO | 2019174293 | A1 | 9/2019 |

OTHER PUBLICATIONS

International Search Report of the International Search Authority issued in PCT/CN2018/115957 dated Feb. 22, 2019.
Written Opinion of the International Search Authority issued in PCT/CN2018/115957 dated Feb. 22, 2019.
Partial European Search Report of Corresponding EP Application 18909295.0-1212/3767662 PCT/CN2018115957, (dated Mar. 30, 2021).
Extended Search Report of Corresponding EP Application 18909295.0 dated Jul. 6, 2021.
Translated First Office Action of Corresponding Application JP2020-570614 dated Sep. 14, 2021.

* cited by examiner

COMBINED MACHINE HEAD AND RAY IMAGING DEVICE

RELATED APPLICATIONS

This application is a US National Stage entry of International Application No. PCT/CN2018/115957, filed Nov. 16, 2018, published in Chinese. This application also claims priority to Chinese Patent Application No. 201810208702.7 filed with CNIPA on Mar. 14, 2018, the entirety of which is incorporated herein by reference.

TECHNICAL FIELD

The present application relates to the technical field of medical device, and specifically to a combined machine head and a ray imaging device.

BACKGROUND

The combined machine head comprising a ray tube is used to generate rays. For example, the X ray tube in the X-ray combined machine head is used to generate X-rays. The combined machine head is usually assembled with an image sensor such as a CCD, a processor, and a bracket to form a complete X-ray machine product, such as C-arm X-ray devices, widely used in fluoroscopy in medical operations. The structure of an X-ray combined machine head with a fixed anode X ray tube in the prior art is shown in FIG. 1, and the housing 104 is provided with an X ray tube 101 and a high voltage generator 102 that provides high voltage for the X ray tube 101, and the housing 104 is filled with an insulating oil 103. The X ray tube 101 comprises a vacuum housing 106, and a cathode filament 107, a bunched electrode 108, an anode target 110, and a cooling fin 111 in the vacuum housing 106. During operation, the cathode filament 107 of the X ray tube is connected to the high voltage of the filament transformer, the heated electrons hit the anode target 109, thereby generating X-rays. When X-ray tube generates X-rays, only about 1% of the energy is converted into X-rays, and more than 99% of the energy will be converted into heat building up on the target surface of the anode, whereas the target surface has a limited ability of withstanding heat. If the heat cannot be transferred out in time, the anode target surface will be damaged, when the cumulative amount of heat exceeds the endurance of the anode of the X ray tube, thereby causing damage to the X-ray machine.

For this reason, the X ray tube with a fixed anode shown in FIG. 1 is provided with a cooling fin 111 at the end of the fixed anode target 110, and the cooling fin 111 extends to the exterior of the vacuum housing 106, so as to conduct the heat of the anode target 110 to the outside of the vacuum housing in time, to the insulating oil. In order to improve the heat dissipation efficiency, the surface area of the cooling fin 111 soaked in the insulation oil is often increased. Because the insulation oil in the X-ray combined machine head has a large specific heat capacity, the temperature in the X ray combined machine head can be kept within the normal working range via heat absorption by the insulating oil.

SUMMARY

In this regard, embodiments of the present application provide a combined machine head and a ray imaging device.

A first aspect of the present application provides a combined machine head, comprising: a housing, having an enclosed cavity; a ray tube, arranged in the enclosed cavity; and a pump and a pipe, arranged in the enclosed cavity; wherein the pump is arranged on one side away from an anode of the ray tube, the pipe has a first end connected with an outlet of the pump and a second end extending to be near the anode of the ray tube; or the pump is arranged near the anode of the ray tube, the pipe has a first end connected to an inlet of the pump and a second end extending to one side away from the anode of the ray tube.

Optionally, the housing comprises a cover plate and a housing body, and the combined machine head further comprises: a first insulating barrier, arranged in the enclosed cavity and dividing the enclosed cavity into a first cavity and a second cavity which are communicated; the cover plate is located on a side wall of the first cavity; the ray tube is arranged in the first cavity; and the pump is arranged on one side of the second cavity away from the anode of the ray tube.

Optionally, the cover plate is provided with a first opening which is provided with a transparent cover in a sealed manner, and a ray emergent surface of the ray tube corresponds to a position of the transparent cover.

Optionally, the combined machine head further comprises: a second insulating barrier, arranged in the second cavity to be intersected with the first insulating barrier, and dividing the second cavity into a first sub-cavity and a second sub-cavity, the pump is arranged in the first sub-cavity, and the first sub-cavity is further used to arrange: a high frequency transformer of the combined machine head, with both terminals on a high-voltage side thereof respectively connected with the anode and the cathode of the ray tube; and a filament transformer of the combined machine head, with both terminals on a high-voltage side thereof respectively connected with two terminals of a cathode filament of the ray tube; the second sub-cavity is used to arrange a circuit board of the combined machine head.

Optionally, the high frequency transformer comprises: a first magnetic core, having a column shape; a first frame, having a cylindrical shape and sleeved on the exterior of the first magnetic core; a first coil, wound around an outer wall surface of the first frame; a second frame, having a cylindrical shape and sleeved on the exterior of the first coil; a second coil, wound around an outer wall surface of the second frame; and a second magnetic core, having a column shape, with both ends respectively connected with two ends of the first magnetic core to form a closed magnetic ring.

Optionally, the first coil is a low-voltage coil, and the second coil is a high-voltage coil, with the middle thereof connected to ground.

Optionally, the housing is provided with a second opening, and the combined machine head further comprises: a capsule body, arranged in the enclosed cavity and having an opening connected to the second opening in a sealed manner.

Optionally, an anode target of the ray tube is fixedly arranged, and the ray tube further comprises: a cooling fin, connected to an end of the anode target and extending through the ray tube into the enclosed cavity.

A second aspect of the present application provides a ray imaging device, comprising the combined machine head in any of claims 1 to 8.

Optionally, the ray imaging device is a C-type arm X-ray device.

In the combined machine head and the ray imaging device provide by the embodiments of the present application, a ray tube, a pump and a pipe is arranged in the enclosed cavity, the pump is arranged on one side away from an anode of the ray tube, the pipe has a first end connected with an outlet of the pump and a second end extending to be near the anode of the ray tube; or the pump is arranged near the anode of the ray tube, the pipe has a first end connected to an inlet of the pump and a second end extending to one side away from the anode of the ray tube. The temperature of insulation medium at a position far away from the anode of the ray tube is quite different from that of the insulation medium near the anode. When the pipe works, the other end of the pipe and the other port of the pump are soaked in the insulation medium, allowing the insulation medium at a position away from the anode to be drawn to the vicinity of the anode, and driving the insulation medium in the enclosed cavity to cycle, thereby gradually reducing the temperature difference between the anode position and other positions, making the temperature gradient of the insulation medium in the enclosed cavity distribute more uniformly.

BRIEF DESCRIPTION OF THE DRAWINGS

The features and advantages of the present application will be more clearly understood by referring to the drawings, which are schematic and should not be construed as limiting the present application in any way, in the drawings.

DETAILED DESCRIPTION

In order to make the purpose, technical solutions and advantages in embodiments of the present application clearer, the technical solutions in the embodiments of the present application will be described as follows clearly and completely referring to figures accompanying the embodiments of the present application, and surely, the described embodiments are just part rather than all embodiments of the present application. Based on the embodiments of the present application, all the other embodiments acquired by those skilled in the art without delivering creative efforts shall fall into the protection scope of the present application.

Through a large number of simulation analysis, the inventor found that in the existing X-ray combined machine heads, if the X ray tube works for a long time, the temperature of the insulating oil near the anode of the X ray tube is likely to be higher above that at other parts in the X-ray combined machine head, the uneven temperature gradient distribution causes the temperature of the local insulating oil to be higher than 85° C., resulting in greatly reduced insulation, so that local part in the X-ray combined machine head is prone to sparking. Since X ray tubes usually work for a short period of time (for example, 20 minutes), this problem has not drawn attention from R&D personnel as a safety hazard. Based on this discovery, the inventor obtains the technical solution of the present application during the process of improving the existing X-ray combined machine head.

It should be noted that, the combined machine head in the present application can be an X-ray combined machine head, or a machine head that generates a lot of heat in the process of generating other forms of rays.

Embodiment 1

Figure 2:
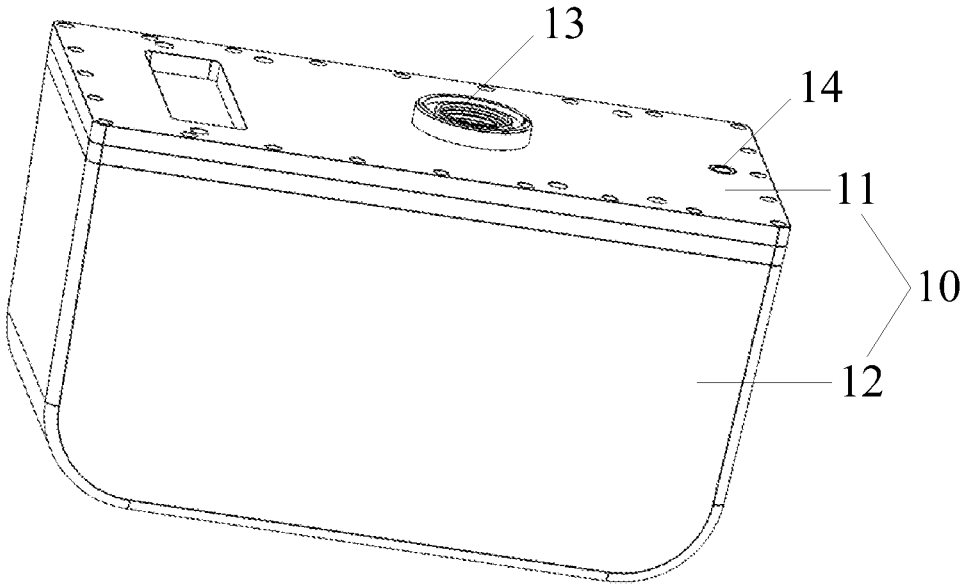
FIG. 2 shows a schematic diagram of the three-dimensional structure of the combined machine head according to the present application embodiment.

An embodiment of the present application provides a combined machine head, as shown in FIG. 2, the combined machine head comprises a housing 10, a ray tube 20, a pump 30 and a pipe 40, wherein the housing 10 has an enclosed cavity, with the ray tube 20, the pump 30 and the pipe 30 arranged therein. When the combined machine head is actually applied, the enclosed cavity is filled with flowable insulation medium.

As shown in FIG. 2, the pump 30 may be arranged on one side away from an anode of the ray tube 20, the pipe 40 has a first end connected with an outlet of the pump 30 and a second end extending to be near the anode of the ray tube 20. The second end of the pipe 40 and an inlet of the pump 30 are soaked in insulation medium. The temperature of insulation medium at a position far away from the anode of the ray tube is quite different from that of the insulation medium near the anode. When the pipe works, the insulation medium at the position of the pump 30 is drawn to flow to the anode of the ray tube 20 through the pipe 40 to reduce the temperature of a bulb tube of the anode, and drive the insulation medium in the enclosed cavity to cycle, thereby gradually reducing the temperature difference between the position of the anode and other positions, making the temperature gradient of the insulation medium in the enclosed cavity distribute more uniformly.

Alternatively, the pump 30 is arranged to be near the anode of the ray tube 20, the pipe 40 has a first end connected with the inlet of the pump 30, and a second end extending to one side away from the anode of the ray tube 20. The second end of the pipe 40 and the inlet of the pump 30 are soaked in the insulation medium. The temperature of insulation medium at a position far away from the anode of the ray tube 20 is quite different from that of the insulation medium near the anode. When the pipe 30 works, the insulation medium at a position away from the anode is drawn by the pipe 40 to the position of the pump 30 to reduce the temperature of the bulb tube of the anode, and drive the insulation medium in the enclosed cavity to cycle, thereby gradually reducing the temperature difference between the position of the anode and other positions, making the temperature gradient of the insulation medium in the enclosed cavity distribute more uniformly.

It needs to be supplemented that the specific heat capacity of the insulation medium in the enclosed cavity is often great, which can generally meet the heat dissipation requirements of the ray tube; in addition, the existing ray machine head is of large size and heavy, therefore, for the existing products, the pump is generally not arranged in the enclosed cavity to occupy the originally limited space.

In addition, it needs to be emphasized that in the embodiments of the present application, the pump is arranged in the enclosed cavity to realize the thermal circulation inside the enclosed cavity, so that the temperature gradient inside the enclosed cavity is evenly distributed. In the prior art, the design of arranging the pump outside the enclosed cavity is to take the heat of the enclosed cavity to the outside to be dissipated, that is, to solve the heat dissipation problem of the insulation medium in the sealed cavity. Actually, the specific heat capacity of the insulation medium in the enclosed cavity is often large, and the insulation medium generally will not experience a great rise in the average temperature as a whole after absorbing a lot of heat, therefore, normally those skilled in the art will not opt to arrange the pump to further solve the heat dissipation problem of the insulation medium.

It should be added that, the specific heat capacity of the insulation medium in the enclosed cavity is often large, which can generally meet the heat dissipation requirements of the ray tube; in addition, generally the volume of the combined machine head is increased to the total heat capacity thereof, so as to achieve long-term exposure, and allow the working temperature to meet the regulatory requirements (less than 65° C.), therefore, for the existing products, a pump is not generally arranged in the enclosed cavity to increase the heat transfer efficiency and reduce the temperature gradient.

In addition, it should be emphasized that in the embodiment of the present application, the pump is arranged in the enclosed cavity to achieve thermal circulation therein, so that the temperature gradient inside the enclosed cavity is evenly distributed, and the heat capacity of the combined machine head is increased. In the prior art the design of arranging the pump outside the enclosed cavity is used to take the heat of the enclosed cavity to the outside to be dissipated, that is, to solve the heat dissipation problem of the insulation medium in the enclosed cavity. Actually, the insulation medium in the enclosed cavity has a great specific heat capacity margin, and the total heat capacity meets the requirement that the average temperature rise during continuous fluoroscopy does not exceed the value stipulated by regulations. Those skilled in the art usually do not arrange the pump to further solve the heat dissipation problem of the insulation medium.

Embodiment 2

Figure 3:
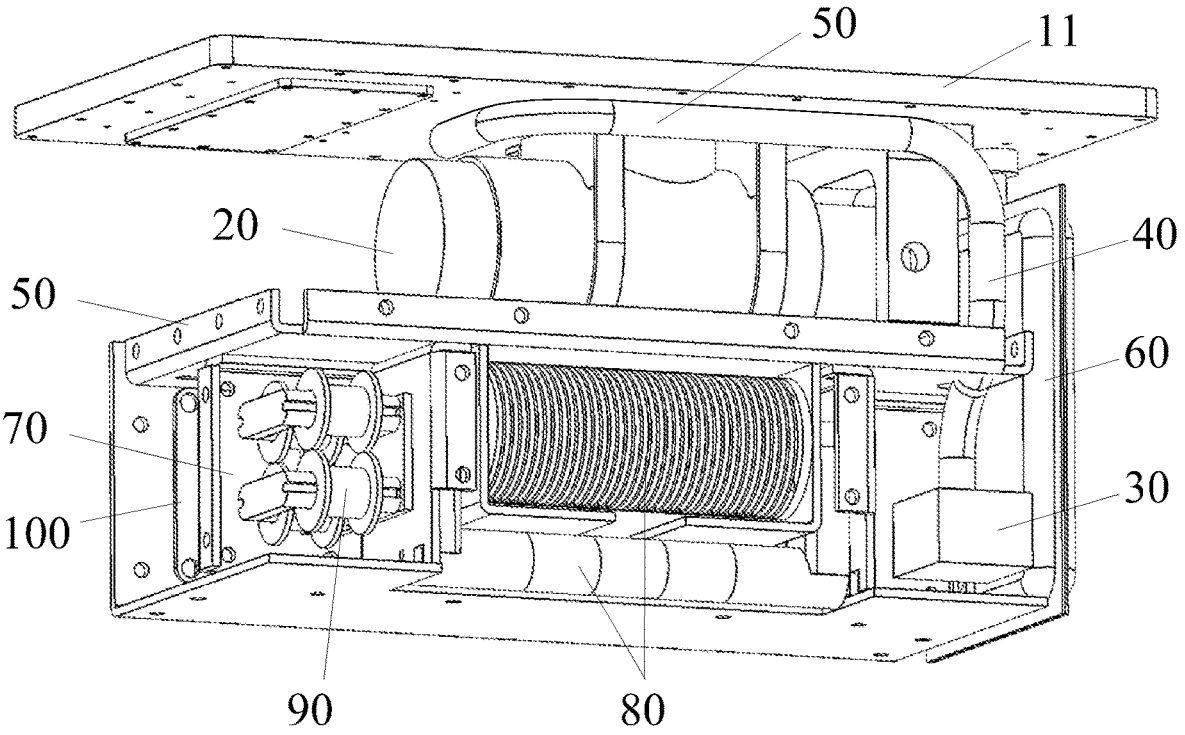
FIG. 3 shows a front view of the combined machine head according to an embodiment of the present application after the housing body is removed.
Figure 4:
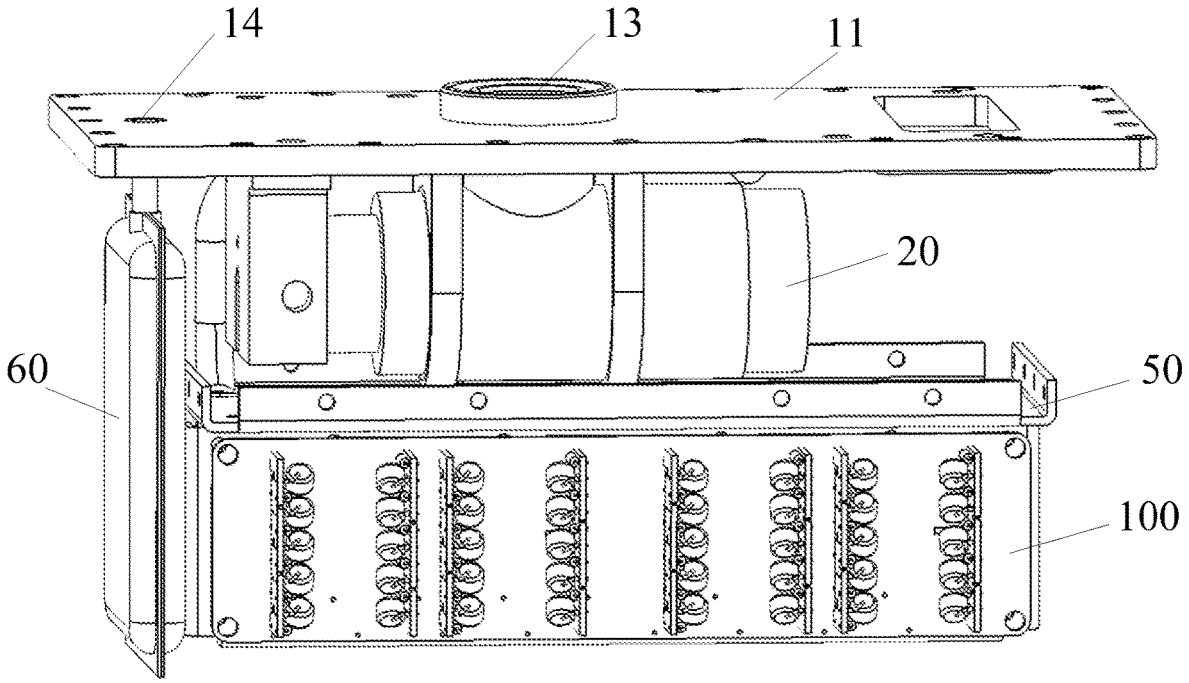
FIG. 4 shows a rear view of the combined machine head according to an embodiment of the present application after the housing body is removed.

An embodiment of the present application provides a combined machine head, which is different from that of the embodiment 1 in that, as shown in FIG. 2 and FIG. 3, the housing 10 comprises a cover plate 11 and a housing body 12. The combined machine head further comprises a first insulating barrier 50 arranged in the enclosed cavity to divide the enclosed cavity into a first cavity and a second cavity which are communicated, the cover plate 11 is arranged on a side wall of the first cavity, a ray tube 20 is arranged in the first cavity, the pump 30 is arranged on one side away from the anode of the ray tube 20 in the second cavity. As shown in FIG. 2 and FIG. 4, the cover plate 11 is provided with a first opening 13 which is provided with a transparent cover in a sealed manner, and a ray emergent surface of the ray tube 20 corresponds to a position of the transparent cover, i.e., an opening is correspondingly arranged to serve as an emergent window of the rays.

It should be supplemented that the first opening 13 can be provided on the cover plate 11 or the housing body 12.

Figure 5:
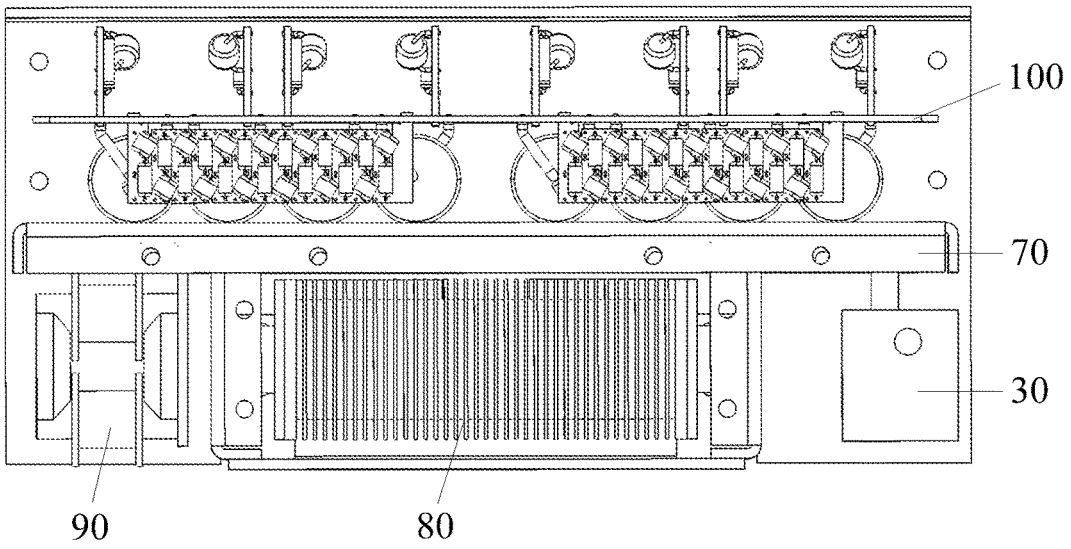
FIG. 5 shows a top view of a second cavity in the combined machine head shown in FIG. 3.

Further, the combined machine head further comprises a second insulation plate 70 arranged in the second cavity to be intersected with (preferably, perpendicular to) the first insulating barrier 50, for dividing the second cavity into a first sub-cavity and a second sub-cavity. The pump 30 is arranged in the first sub-cavity. The first sub-cavity is further used to accommodate a high frequency transformer 80 and a filament transformer 90 arranged therein which are essential for the combined machine head, as shown in FIG. 3 and FIG. 5, wherein the high frequency transformer 80 is respectively connected with the anode and cathode (which are usually connected to the ray tube 20 following double voltage rectification) of the ray tube 20, for providing a voltage difference for the cathode and anode of the ray tube. Two terminals of a high-voltage side of the filament transformer 90 are respectively connected with two terminals of a cathode filament of the ray tube 20, for providing electrical energy for the cathode filament of the ray tube. The second sub-cavity is used to arrange a circuit board 100 of the combined machine head, and the circuits can be a voltage boost circuit, a voltage doubling circuit, a frequency doubler circuit, a filter circuit, a rectifier circuit, etc., as shown in FIG. 4 and FIG. 5, many capacitors, resistors and other components are often adopted to attach to the circuit board 100.

Figure 6:
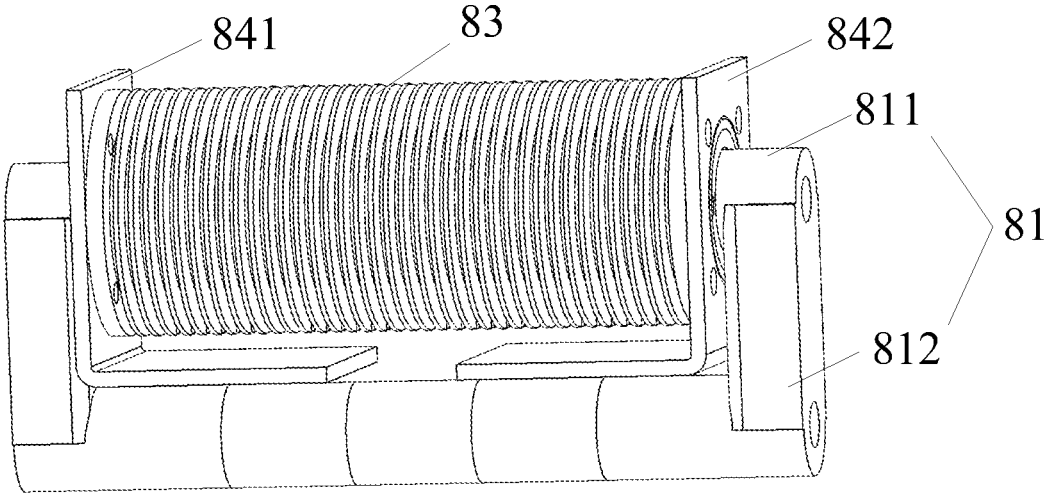
FIG. 6 shows a schematic diagram of a three-dimensional structure of a transformer according to an embodiment of the present application.
Figure 7:
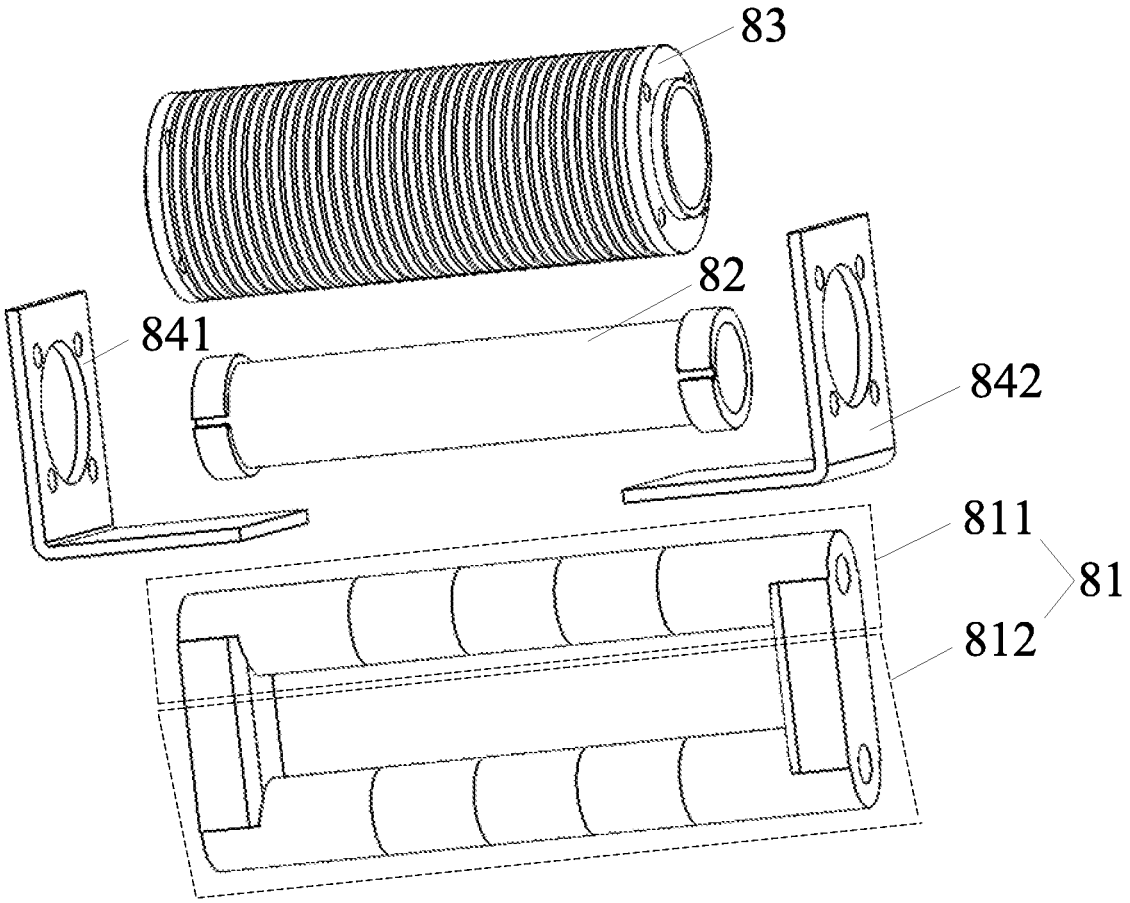
FIG. 7 shows an exploded view of a transformer shown in FIG. 4.

Optionally, this embodiment provides a high frequency transformer, as shown in FIG. 6 and FIG. 7, comprising a first magnetic core 811, a second magnetic core 812, a first frame 82, a first coil, a second frame 83 and a second coil. The first magnetic core 811 has a column shape, the first frame 82 is sleeved on the exterior of the first magnetic core 811, the first coil is wound around an outer wall surface of the first frame 82, the second frame 83 is sleeved on the exterior of the first coil, the second coil is wound around an outer wall surface of the second frame 83, the second magnetic core 812 have both ends respectively connected with two ends of the first magnetic core 811 to form a closed magnetic ring 81. The first coil is a low-voltage coil, and the second coil is a high-voltage coil, with the middle thereof connected to ground.

The first coil and second coil of the high frequency transformer are respectively sleeved on the first frame and the second frame, the second frame is sleeved on the exterior of the first coil, a column portion in the closed magnetic ring passes through a cavity of the first frame, therefore, the winding parameters of the first coil and the second coil are uniform, and the magnetic leakage, inductance leakage, and distributed capacitance of different turns of the same coil are also the same. Therefore, the positive and negative high voltages output by the high frequency transformer provided by the embodiment of the present application are more balanced.

Figure 8:
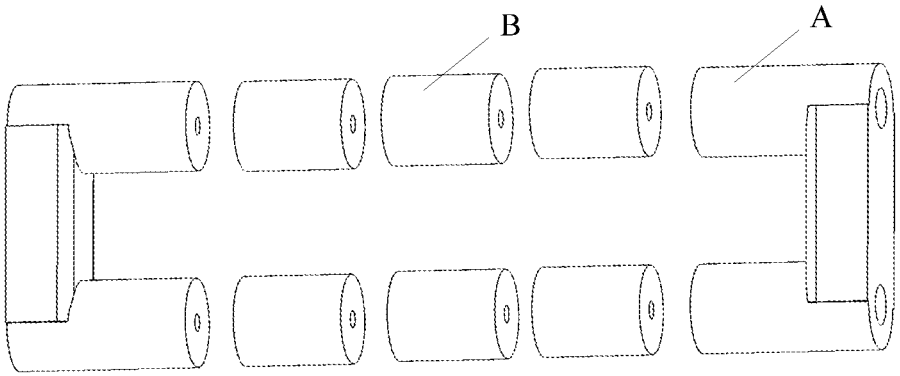
FIG. 8 shows a schematic view of the three-dimensional structure of a magnetic ring in the transformer shown in FIG. 4.

Optionally, the above-mentioned first magnetic core 811 is of a more regular straight column shape, further improving the consistency of coil winding parameters. The second magnetic core 812 can be U-shaped to form a closed magnetic ring. It should be supplemented that in this optional implementation, the first magnetic core 811 and second magnetic core 812, which are not necessarily separate parts, can be divided conceptually, as long as they can form a closed magnetic ring, with a part thereof being a straight column type. For example, as shown in FIG. 8, the closed magnetic ring can comprise two U-shaped magnetic columns A and a plurality of straight-columned magnetic columns B. The straight-columned magnetic column in the present application means that the upper and lower ends of the magnetic column are parallel and perpendicular to the plain line of the magnetic column.

Figure 9:
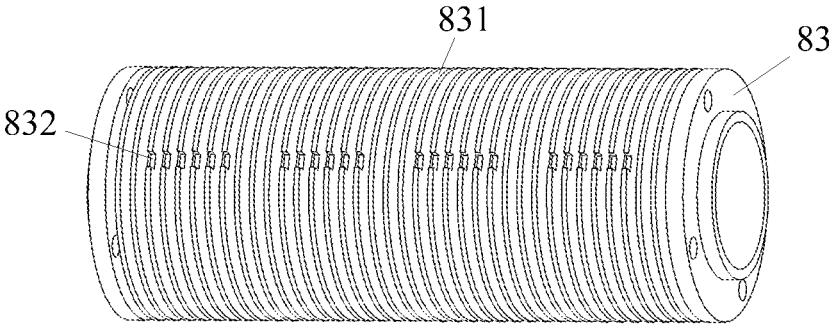
FIG. 9 shows a schematic diagram of the three-dimensional structure of the second frame in the transformer shown in FIG. 4.

As shown in FIG. 9, the circumferential outer wall surface of the second frame 83 is provided with at least three annular grooves 831, an annular protrusion is formed between two adjacent annular grooves, and the spacing between the two adjacent annular grooves is equal. The second coil is wound in the annular groove on the second insulating frame 83 sequentially, and generally spirally wound on the outer wall surface of the second frame 83.

The annular protrusion is provided with a notch 832 that connects two adjacent annular grooves. In the winding direction of the second coil, for the coils in the two adjacent annular grooves, the coil in the rear annular groove has a tail end passing through the notch to be connected to a start end of the coil in the front ring groove. For example, the second coil can be wound in annular groove A for multiple turns, and then the tail end of the coil extends through the notch on the annular protrusion into the annular groove to be wound in multiple turns. It can be seen that the design of the annular groove on the second frame 83 enables the second coil to be wound in quite a lot of turns even when the outer wall surface is small, thereby outputting a higher voltage. The second frame 83 is made of an insulating material, and insulating protrusions in adjacent annular grooves can improve the insulation between coils in adjacent annular grooves. Optionally, connection lines among all of the notches 832 are a straight line which is parallel to the axis of the second frame.

Figure 10:
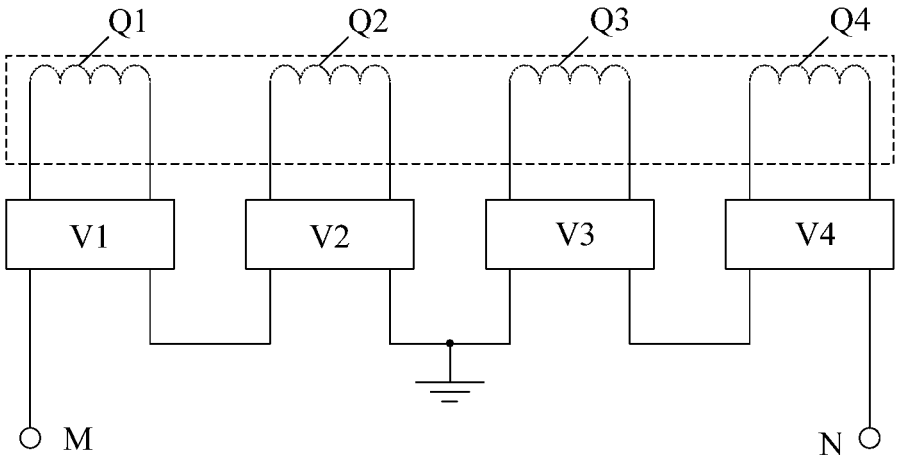
FIG. 10 shows an elementary diagram of a transformer according to an embodiment of the present application.

There can be one second coil with the middle grounded. As an optional implementation of the embodiment, as shown in FIG. 10, there are four second coils, Q1, Q2, Q3, Q4, spaced apart along an axis of the second frame 30 on the outer wall surface thereof. At the same time, the transformer further comprises four voltage doubling circuit modules, V1, V2, V3, and V4, corresponding to the second coil in one-to-one correspondence and used to amplify and output the input voltage by a predetermined times. The input terminal of each voltage doubling circuit module is connected to two terminals of a corresponding second coil, and the output terminals of the four voltage doubling circuits are sequentially connected in series, and the two terminals MN after the series connection are used as the output terminals of the transformer, and one terminal of the two second coil arranged at the middle part of the second frame 30 axially is grounded, as shown in FIG. 10. On the one hand, the high voltage output by the transformer boosts the voltage assisted by the voltage doubling circuit module without relying on the coil, which can greatly reduce the number of turns of the coil, thereby reducing the size of the transformer. On the other hand, due to the grounding of the two second coils in the middle part, the potential of each second coil is reduced; the two second coils that are grounded at the middle part and closer to each other have the lowest potential, and those adjacent one on the two sides have similar potentials, thereby reducing the requirements for insulation of the second frame 30, which can have annular protrusions with a smaller thickness for electrical isolation between the coils, reducing the volume of the transformer.

It needs to be supplemented that, the number of above-mentioned second coil can be even number, such as 2, 6, 8 . . . other than 4. Correspondingly, the number of the voltage doubling circuit modules can correspondingly be 2, 6, 8 . . . .

As a variable implementation, the notch can also be a through hole provided on the annular protrusion.

The winding method of the first frame 82 and the second coil (not shown in the drawings) can refer to the design of the second frame 83 and the second coil. Or the groove on the outer wall surface of the first frame 82 can also be a spiral shape, and the corresponding coil is wound on the outer wall surface spirally. However, with this design, the coil must be wound to follow the groove. Only one turn of coil can be wound in the groove, leading to a low utilization rate of the groove, thus it is difficult for the second frame to output a high voltage when the second frame has a small diameter and short length. Therefore, in order to miniaturize the high frequency transformer, it is not recommended to use spiral grooves for the second frame 83.

As an optional implementation of this embodiment, the closed magnetic ring has a rectangular frame structure. As shown in FIGS. 6 and 7, the high frequency transformer further comprises insulation plates 841 and 842, with one ends thereof fixedly arranged at the end of the second frame 83 and the other end bent towards the outer wall surface of the second frame 83 and located between the second coil and the second magnetic core 812 to prevent the coil from igniting the magnetic core. The portions of the insulation plates 841 and 842 between the second coil and the second magnetic core 812 can also be connected to form an insulation plate with both ends fixed on an end face of the second frame 83.

As an optional implementation of this embodiment, when the combined machine head works, most of the heat emitted by the ray tube 20 is eventually absorbed by the insulation medium in the enclosed cavity, causing the insulation medium to expand in volume, which in turn deforms the housing. To this end, the housing 10 of the combined machine head provided by the embodiment of the present application is provided with a second opening 14, as shown in FIGS. 2 and 4; and the combined machine head further comprises a capsule 60 arranged in the enclosed cavity, the opening of the capsule 60 and the second opening 14 are hermetically connected, as shown in FIGS. 3 and 4. The inner cavity of capsule 60 is connected to the outer space, and when the volume of the insulation medium is expanded the capsule 60 will be squeezed first, so as to prevent housing 10 from being squeezed and deformed.

Figure 1:
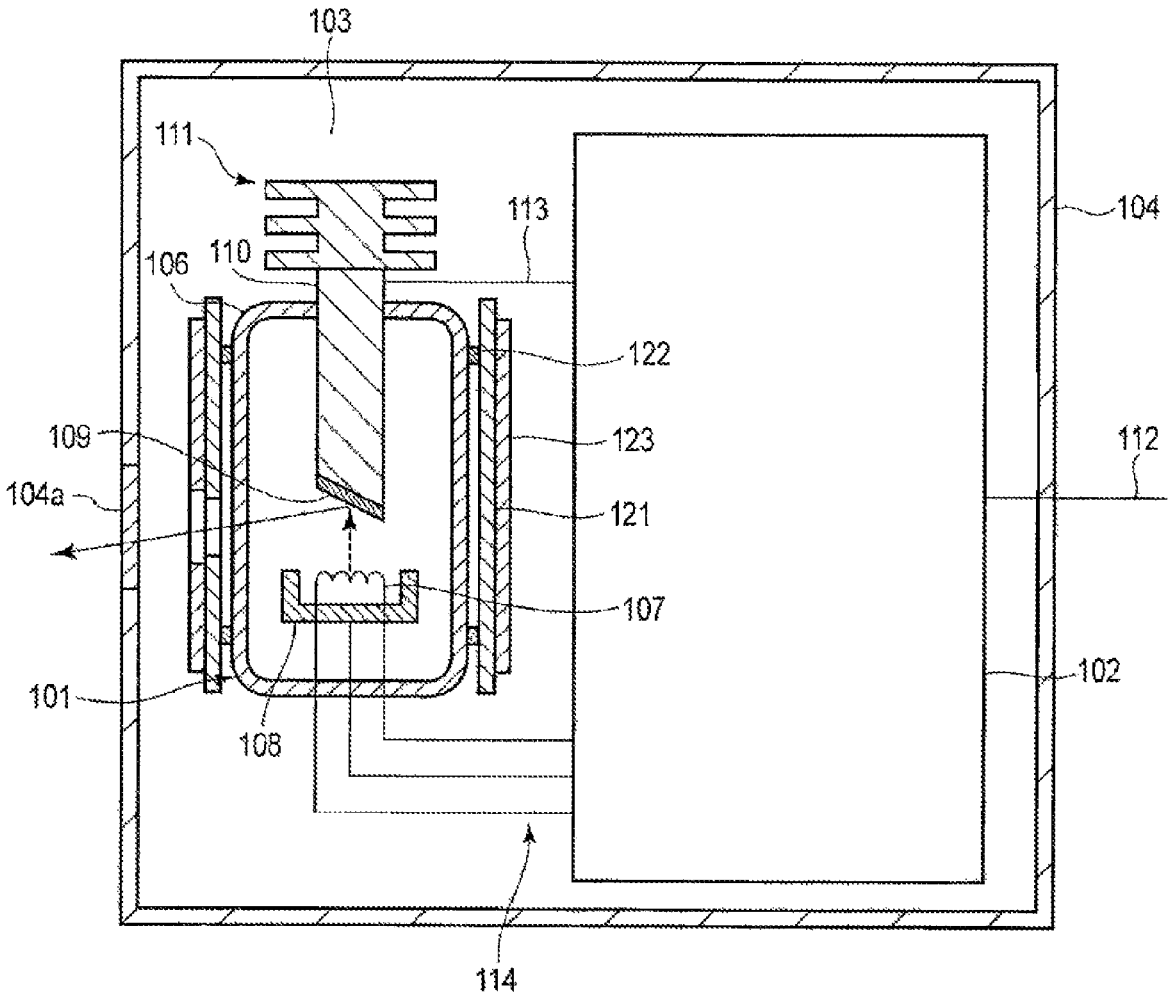
FIG. 1 shows a schematic diagram of the heat dissipation of the existing combined machine head.

The anode target of the ray tube in the embodiment of the present application can be a fixed anode target or a rotating anode target. As an optional implementation of this embodiment, the anode target of the ray tube 20 is fixedly arranged (usually referred to as a Monoblock or Monotank), and the ray tube 20 further comprises a cooling fin (see FIG. 1), which is connected to the end of the anode target, and penetrates the ray tube 20 into the enclosed cavity. The cooling fin can rapidly transfer the large heat on the anode target to the insulation medium in the enclosed cavity through heat conduction.

Embodiment 3

An embodiment of the present application provides a ray imaging device, comprising the combined machine head in embodiment 1 or embodiment 2 or in any optional implementations thereof.

Optionally, the ray imaging device C-type arm X-ray device.

Although the embodiments of the present application are described in conjunction with the accompanying drawings, those skilled in the art can make various modifications and variations without departing from the spirit and scope of the present application, and such modifications and variations fall into the scope defined by the attached claims.

The invention claimed is:

1. A combined machine head, comprising:

a housing, having an enclosed cavity;

an X-ray tube, arranged in the enclosed cavity; and a pump and a pipe, arranged in the enclosed cavity;

wherein the pump is arranged on one side away from an anode of the X-ray tube, the pipe has a first end connected with an outlet of the pump and a second end extending to be near the anode of the X-ray tube; or the pump is arranged near the anode of the X-ray tube, the pipe has a first end connected to an inlet of the pump and a second end extending to one side away from the anode of the X-ray tube;

wherein the housing comprises a cover plate and a housing body, and the combined machine head further comprises a first insulating barrier arranged in the enclosed cavity and dividing the enclosed cavity into a first cavity and a second cavity which are communicated, the cover plate is located on a side wall of the first cavity, the X-ray tube is arranged in the first cavity; and the pump is arranged on one side of the second cavity away from the anode of the X-ray tube; and wherein the combined machine head further comprises a second insulating barrier, arranged in the second cavity to be intersected with the first insulating barrier, and dividing the second cavity into a first sub-cavity and a second sub-cavity, the pump is arranged in the first sub-cavity, and the first sub-cavity is further used to arrange:

a high frequency transformer of the combined machine head, with both terminals on a high-voltage side thereof respectively connected with the anode and a cathode of the X-ray tube; and a filament transformer of the combined machine head, with both terminals on a high-voltage side thereof respectively connected with two terminals of a cathode filament of the X-ray tube; and the second sub-cavity is used to arrange a circuit board of the combined machine head.

2. The combined machine head of claim 1, wherein, the cover plate is provided with a first opening which is provided with a transparent cover in a sealed manner, and an X-ray emergent surface of the X-ray tube corresponds to a position of the transparent cover.

3. The combined machine head of claim 2, wherein, the housing is provided with a second opening, and the combined machine head further comprises:

a capsule body, arranged in the enclosed cavity and having an opening connected to the second opening in a sealed manner.

4. The combined machine head of claim 1, wherein, the high frequency transformer comprises:

a first magnetic core, having a column shape;

a first frame, having a cylindrical shape and sleeved on the exterior of the first magnetic core;

a first coil, wound around an outer wall surface of the first frame;

a second frame, having a cylindrical shape and sleeved on the exterior of the first coil;

a second coil, wound around an outer wall surface of the second frame; and a second magnetic core, having a column shape, with both ends respectively connected with two ends of the first magnetic core to form a closed magnetic ring.

5. The combined machine head of claim 4, wherein, the first coil is a low-voltage coil, and the second coil is a high-voltage coil, with the middle thereof connected to ground.

6. The combined machine head of claim 1, wherein, an anode target of the X-ray tube is fixedly arranged, and the X-ray tube further comprises:

a cooling fin, connected to an end of the anode target and extending through the X-ray tube into the enclosed cavity.

7. An X-ray imaging device, comprising the combined machine head in claim 1.

8. The X-ray imaging device of claim 7, wherein, the X-ray imaging device is a C-type arm X-ray device.

* * * * *